US007112081B1

(12) United States Patent
Kruysman

(10) Patent No.: US 7,112,081 B1
(45) Date of Patent: Sep. 26, 2006

(54) HERMAPHRODITIC ELECTRICAL COUPLING ASSEMBLY

(76) Inventor: Christopher Kruysman, 1352 Lee Way, Forked River, NJ (US) 08731

( * ) Notice: Subject to any disclaimer, the term of this patent is extended or adjusted under 35 U.S.C. 154(b) by 164 days.

(21) Appl. No.: 11/154,296

(22) Filed: Jun. 16, 2005

(51) Int. Cl.
*H01R 13/28* (2006.01)

(52) U.S. Cl. ..... 439/295

(58) Field of Classification Search ..... 439/284, 439/295, 289–293
See application file for complete search history.

(56) References Cited

U.S. PATENT DOCUMENTS 3,526,870 A * 9/1970 Mayala ..... 439/397
4,449,778 A * 5/1984 Lane ..... 439/610
4,702,538 A * 10/1987 Hutter et al. ..... 439/292
4,963,102 A * 10/1990 Gettig et al. ..... 439/291
5,328,380 A * 7/1994 Carney ..... 439/188
5,575,695 A * 11/1996 De Bernardis ..... 439/838
5,800,196 A * 9/1998 Rudoy et al. ..... 439/284

* cited by examiner

*Primary Examiner*—James R. Harvey
(74) *Attorney, Agent, or Firm*—Clifford G. Frayne

(57) ABSTRACT

A molded housing of suitable, non-conductive material encasing and segregating a plurality of spring-loaded terminal connector tabs that embody stab connections to receive wire in the rear of the housing for the purpose of conducting current through the insulated terminal tabs to an identical yet inverted hermaphroditic mate for the purpose of connecting multiple wires to multiple wire to wire connections, wire to fixture connections, or series harness connections and the like.

10 Claims, 5 Drawing Sheets

HERMAPHRODITIC ELECTRICAL COUPLING ASSEMBLY

BACKGROUND OF THE INVENTION

1. Field of the Invention

The present invention relates to a molded housing of suitable, non-conductive material encasing and segregating a plurality of spring-loaded terminal connector tabs that embody stab connections to receive wire in the rear of the housing for the purpose of conducting current through the insulated terminal tabs to an identical yet inverted hermaphroditic mate for the purpose of connecting wire to wire, fixtures, series harnesses and the like.

2. Description of the Prior Art

Hermaphroditic connectors provide reliable means for connecting and disconnecting a plurality of electrical conductors. The manufacturing advantages are obvious in that one piece serves as both pieces of a connective set. Previous patent examples attest to the practicality of manufacture, functionality of use and varied applications of hermaphroditic connectors. See Gettig, et al., U.S. Pat. No. 4,963,102, and Rudoy, et al., U.S. Pat. No. 5,800,196.

The preceding references depict hermaphroditic connectors with similar features to each other. Most of the connectors are configured to be factory wired with molded entry rears or at best require the use of a separate "crimp" type conductive terminal with a blade extension to be inserted into the harness at time of use. The most obvious difference distinguishing the present invention from the prior art is the embodiment of low pressure "stab" connectors located at the rear of the housing. This allows for the fast reliable and field operable attachment of wire to connector.

OBJECTS OF THE INVENTION

An object of the present invention is to provide for a novel hermaphroditic connector or coupling which permits connection of a plurality of wire to wire connections, wire to fixture connections, or series harness connections.

A further object of the present invention is to provide for a novel hermaphroditic connector which allows for fast and secure connection requiring low insertion force.

A still further object of the present invention is to provide for a novel hermaphroditic connector which facilitates multiple wire connection which facilitates quick and positive multiple wire connections which are easily releasable if so desired.

A still further object of the present invention is to provide for a novel hermaphroditic electrical connector which provides for a plurality of stab connectors and parallel communication with each other within the hermaphroditic connector which facilitates quick, positive connections which are easily releasable if desired.

SUMMARY OF THE INVENTION

A molded housing of suitable, non-conductive material encasing and segregating a plurality of spring-loaded terminal connector tabs that embody stab connections to receive wire in the rear of the housing for the purpose of conducting current through the insulated terminal tabs to an identical yet inverted hermaphroditic mate for the purpose of connecting multiple wires to multiple wire to wire connections, wire to fixture connections, or series harness connections and the like.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
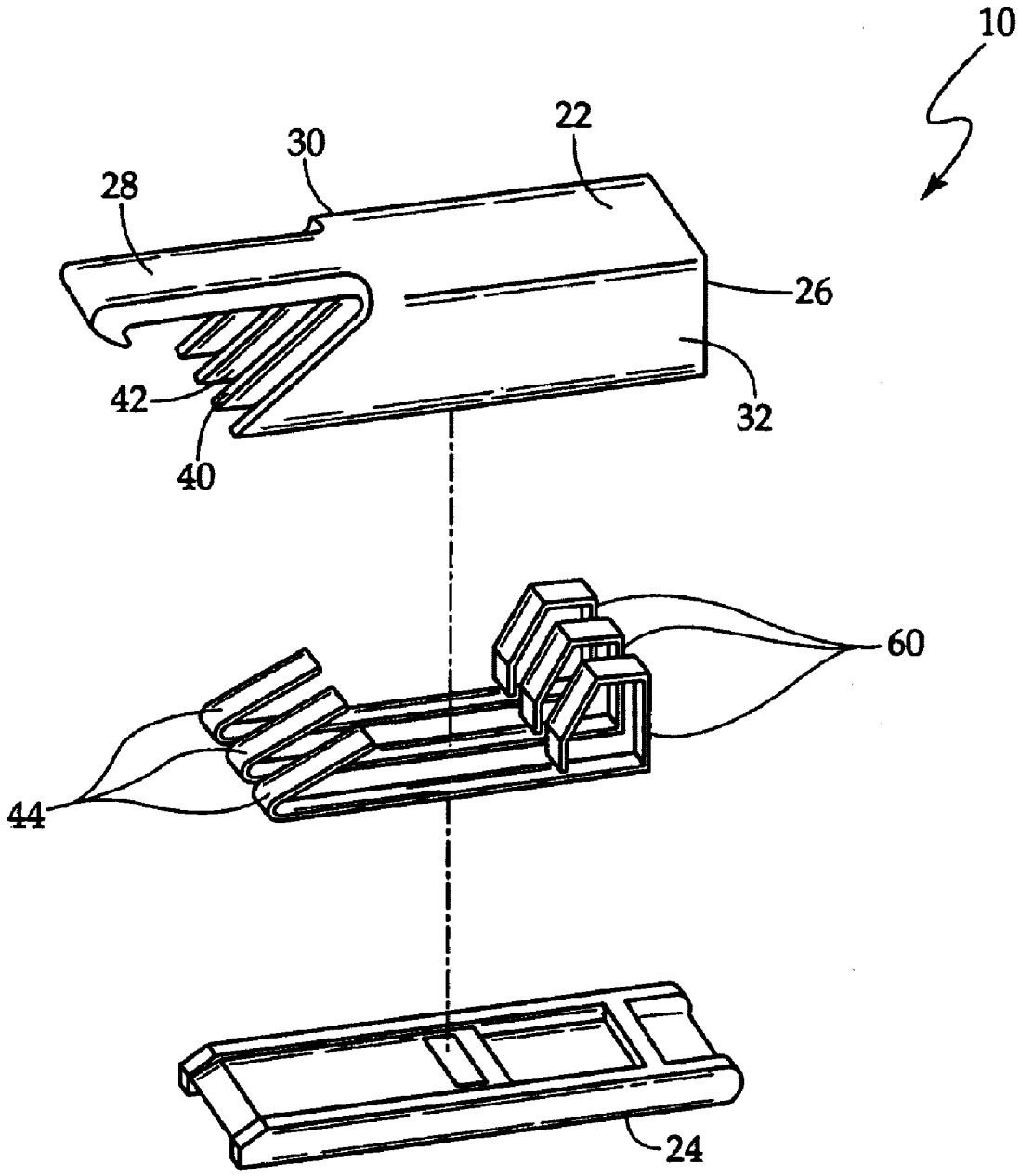
FIG. 1 is an exploded view of a hermaphroditic housing mate illustrating one set of stab connectors.
Figure 2:
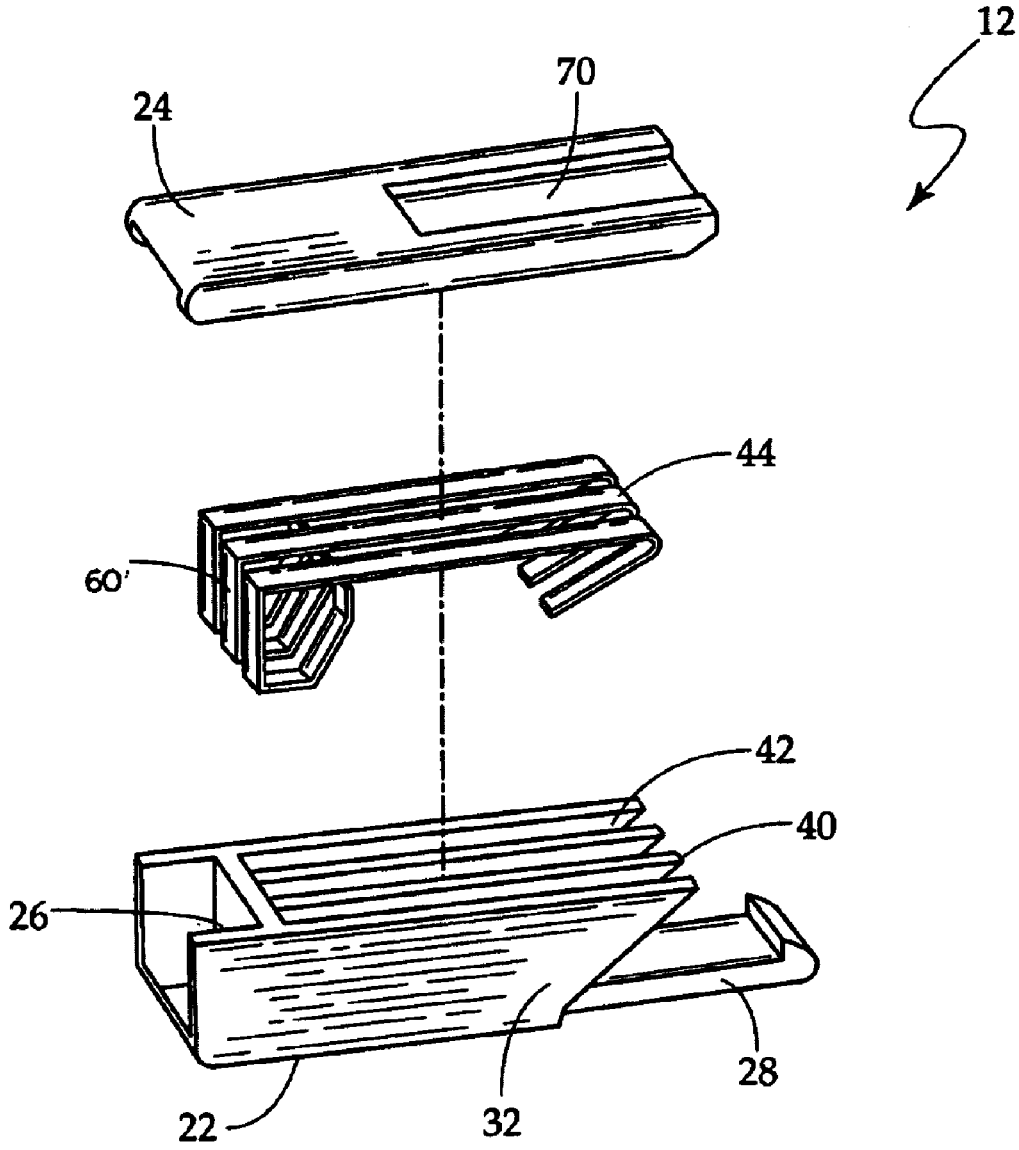
FIG. 2 is an exploded view of the opposing inverted half of the hermaphroditic housing mate and associated stab connectors.
Figure 3:
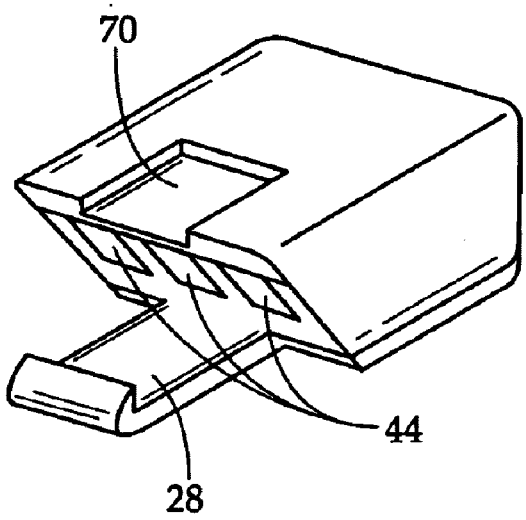
FIG. 3 is a perspective view of the hermaphroditic connector mate of FIG. 2.
Figure 4:
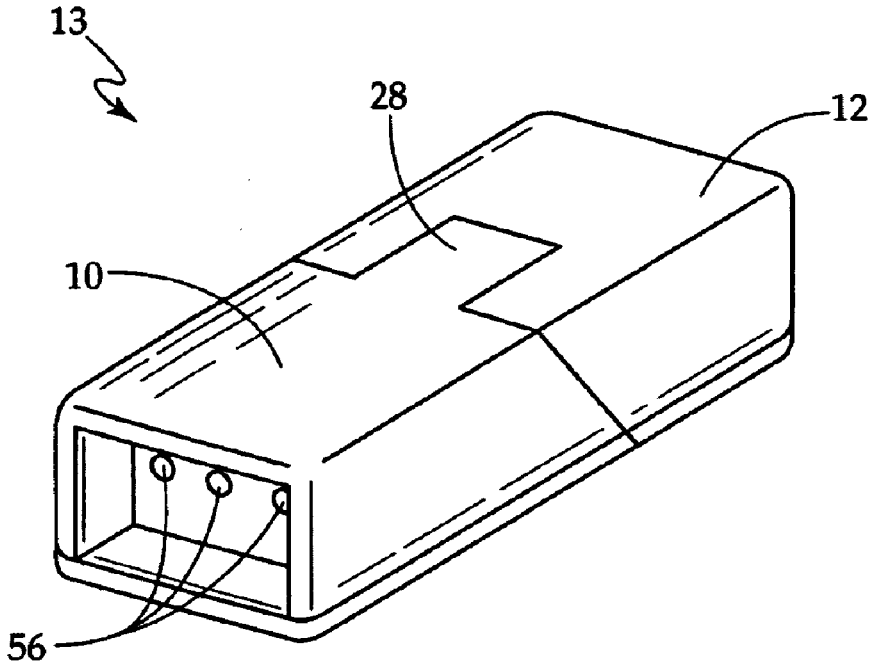
FIG. 4 is a perspective view of the inverted connector members illustrating the locking of the hermaphroditic mates to form the connection to each other.

FIG. 1 is an exploded view of a first hermaphroditic mate member 10 and FIG. 2 is an exploded view of a second inverted hermaphroditic mate member 12 which when mated form a coupling housing 13 as illustrated in FIG. 4. First and second hermaphroditic mate members 10 and 12 are of identical construction and when one is inverted, they snap fit together to form a positive electrically conductive connection 13. This will be apparent when considering the exploded views of first hermaphroditic mate member 10 and second inverted hermaphroditic mate member 12 as illustrated in FIGS. 1 and 2. First and second hermaphroditic mate members 10 and 12 are defined by top wall 22, bottom wall 24, and end wall 26 and opposing side walls 30 and 32, top wall 22 having an extending latching member 28 as will be described hereafter. Disposed between opposing side walls 30 and 32 are a series of rib members 40 which define a series of channels 42 within first and second hermaphroditic mate members 10 and 12. The channels 42 defined by the rib members 40 are for receipt of conductive stab connectors 44. Not shown in FIG. 1, but illustrated in FIG. 4, the end wall 26 of hermaphroditic mate members 10 and 12 have a plurality of apertures 56 for the insertion of wire. The stab connectors 44 are secured within the hermaphroditic mate member 10 such that an apertures 60 in each of the stab connectors 44 (See FIG. 6), are alignable with a respective apertures 56 in the end wall 26 of the hermaphroditic mate member 10.

Hermaphroditic mate member 12 as illustrated in the exploded view of FIG. 2 is the inverted version of hermaphroditic mate member 10. It secures between its ribs 40, a plurality of like stab connectors 44 identical to the stab connectors 44 of hermaphroditic mate member 10 except that they are inverted. Apertures 60 on stab connectors 44 of hermaphroditic mate member 12 are alignable with apertures 56 in the end wall 26 of the hermaphroditic mate member 12. Hermaphroditic mate member 10 and inverted hermaphroditic mate 12 are secured by their respective latching members 38 and a recessed slotted keeper 70 on their respective bottom walls 24. FIG. 4 illustrates the hermaphroditic mate member 10 and inverted hermaphroditic mate member 12 in a mated and locked position.

Figure 6:
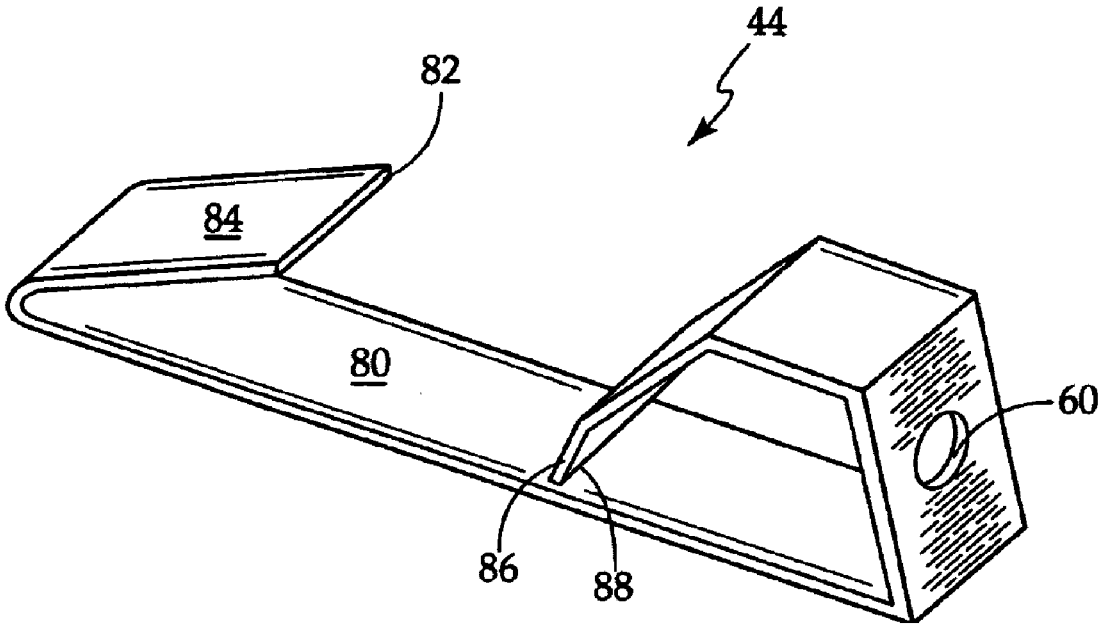
FIG. 6 is a perspective view of a stab connector utilized in the hermaphroditic coupling of the present invention.

Each stab connector 44, as illustrated in FIG. 6 consists of a longitudinal web portion 80 having a first end 82 folded upon the web portion 80 so as to form an acute angle which constitutes a conductive terminal end 84. The opposing end 86 of web portion 80 is folded or bent a series of times to the same side of the web 30 as the first end 82 such that the second end 86 is distal proximate the web portion 80 forming gap 88 which forms the stab connector. The bending of the stab connectors 44 provides appropriate spring tension to both ends allowing usage thereof with hard wire found in the internal wiring of a structure as well as braided wire utilized in fixtures.

Figure 5:
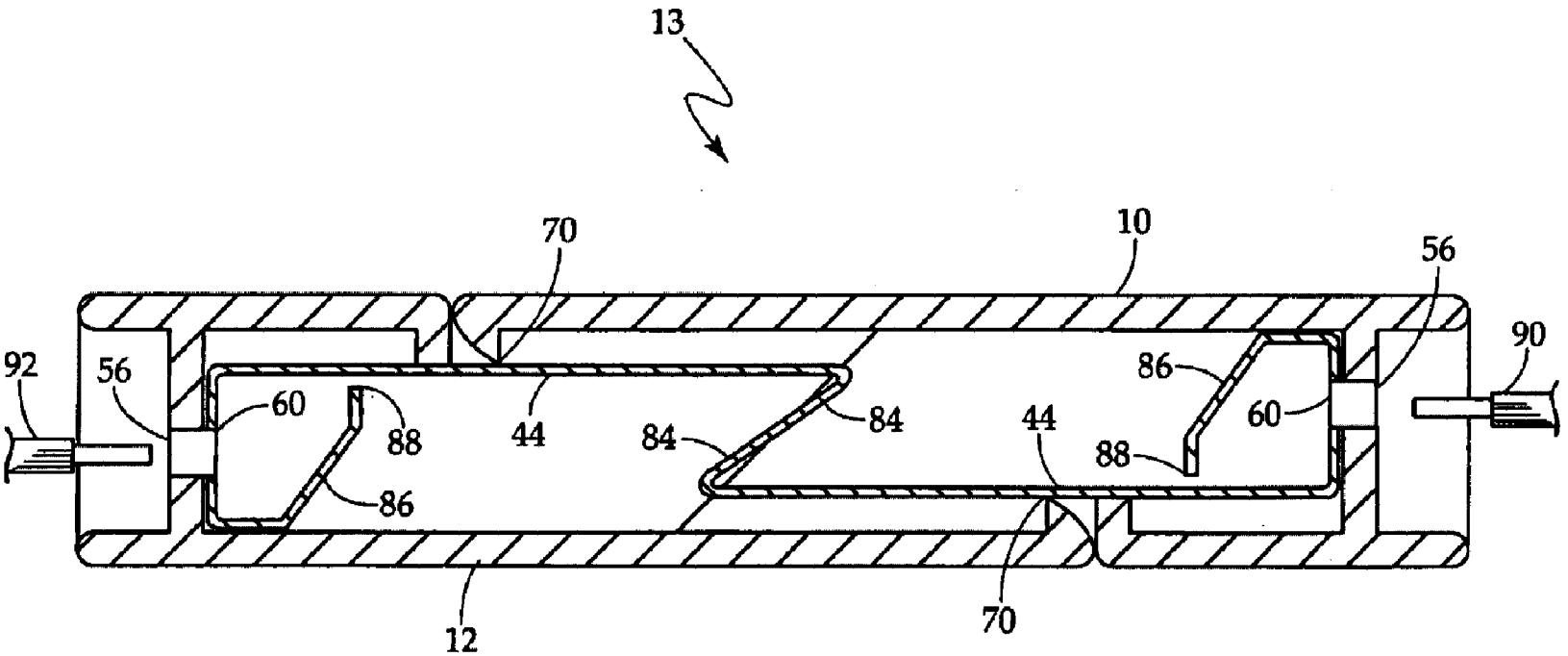
FIG. 5 is a cross sectional view of two hermaphroditic connectors engaged in a locking position.

As better can be understood from FIG. 5 which is a cross sectional view of FIG. 4 along its longer axis, when hermaphroditic mate member 10 and inverted hermaphroditic mate member 12 are in a locked and mated position, the terminal portion 84 of stab connectors 44 of hermaphroditic mate member 10 are in contact with the terminal portion 84 of stab connectors 44 of inverted hermaphroditic mate member 12. Therefore, when a wire 90 is inserted through an aperture 56 in hermaphroditic mate member 10, it passes through an aperture 60 in stab connector 44, contacts the bent end 86 of the respective stab connector and is directed into the gap 88 and secured. When a similar wire 92 is inserted through the corresponding aperture 56 in the opposing inverted hermaphroditic mate member 12, it is directed in a similar manner by the stab connector in order to secure the wire. The two wires 90 and 92 are now in electrical communication as a result of their contact with their respective stab connectors and the fact that the terminal ends 84 of the stab connectors are in abutting relationship.

Hermaphroditic mate members 10 and 12 are identical and when one is inverted, the two of them mate as illustrated in FIG. 4. They are constructed of a suitable insulative, non-conductive material. The vertical ribbing members are formed unitarily with the hermaphroditic mates and are of the same material so as to insulate adjacent stab connectors and prevent arcing, corona discharge or water born shorting. The conductive terminal ends 84 of the stab connectors protrude slightly beyond their respective hermaphroditic mate members 10 and 12 which facilitates positive, spring tensioned, conductive contact with the opposing conductive terminals when the hermaphroditic mate members are engaged in the locked position.

The embodiment illustrated in FIGS. 1 through 5 represents three stab connectors associated with each hermaphroditic mate member. It will be recognized by those of ordinary skill in the art that depending upon the wiring requirements, a hermaphroditic coupling of the type disclosed herein may be constructed in which fewer stab connectors or more stab connectors may be secured within a hermaphroditic coupling designed to accommodate same without departing from the spirit and scope of the invention.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A hermaphroditic electrical coupling assembly defined by a pair of coupling members wherein each of said coupling members comprises:

a body member defined by a coupling end and an opposing electrical wire receiving end defined by a plurality of apertures for the passage there through of conductive electrical wire for fixedly securing therein to said body member, said body member comprising a top wall, bottom wall, and opposing side walls, there being disposed between said top wall and said bottom wall a plurality of rib members, said rib members defining channels for a plurality of stab connectors, said stab connectors having an aperture therein alignable with said apertures in said electrical wire receiving end of said body member;

said stab connectors fabricated of conductive material and defined by a central web portion having a first end and a second end bent to the same side of said web, said first end bent at an acute angle with said web portion, said second end bent perpendicularly to said web portion and then bent angularly downwardly terminating distal proximate said web portion thereby defining a retentive gap between said web and said second end, said conductive electrical wire inserted through said aperture in said cable receiving end of said body member and said aperture in said vertical bent portion of said second end of said stab connector is directed through said retentive gap and retentively frictionally engaged by spring tension of said second end bent distal proximate said web in said retentive gap;

said top wall of said body member having an extending locking finger and said bottom wall of said body member having a receiving slot wherein after positioning said stab connectors in said channels of said body members, one of said body members is inverted and said body members are snap locked to each other.

2. The hermaphroditic electrical coupling assembly in accordance with claim 1 wherein there is one aperture in said wire receiving end of said body member per said channel defined by said rib members.

3. The hermaphroditic electrical coupling assembly in accordance with claim 1 wherein said body member is constructed of non-conducting insulative material.

4. The hermaphroditic electrical coupling assembly in accordance with claim 1 wherein said rib members are constructed of non-conductive insulative material to segregate said stab connectors and prevent arcing, corona discharge or water born shorting.

5. The hermaphroditic electrical coupling assembly in accordance with claim 1 wherein said first end of said stab connectors extend beyond said coupling end of said body member facilitating positive conductive contact with an opposing stab connector situated in said opposing body member.

6. A hermaphroditic electrical coupling assembly comprising two identical mating members, hermaphroditic electrical coupling assembly comprising:

a first and second mating member, each mating member defined by a top wall, bottom wall, opposing side walls, one end wall, and an open coupling end, said top wall of said mating members having an extending locking finger at said open coupling end; said bottom wall of each of said mating members having a receiving slot for receipt of said locking finger, each of said mating members formed with a plurality of internal ribs extending between said top wall and said bottom wall, said ribs defining distinct segregated channels, each channel having an aperture formed in said end wall for insertion of a wire;

a plurality of stab connectors slidably receivable and segregated within said channels of said first and second mating member, said stab connectors fabricated of conductive material and defined by a central web portion having a first end and a second end bent to the same side of said web, said first end bent at an acute angle with said web portion, said second end bent perpendicular to said web portion and then bent angularly downwardly terminating distal proximate said web portion thereby defining a retentive gap between said web and said second end, said vertical bent portion of said second end of said stab connector having an aperture there through, alignable with said aperture in said end wall of said mating member for passage there through of said wire for frictional engagement in said retentive gap of said second bent end of said stab connector, one of said mating member thus described, being inverted so as to snap fit with said remaining mating member by means of said extending finger on said top wall and said receiving slot on said bottom wall thereby providing a double latch securing means for said hermaphroditic electrical coupling placing said first end of said stab connector in abutting conductive contact with an identical yet inverted first end of said stab connector positioned in said inverted mating member.

7. The hermaphroditic electrical coupling assembly in accordance with claim 6 wherein said body member is constructed of non-conducting insulative material.

8. The hermaphroditic electrical coupling assembly in accordance with claim 6 wherein said rib members are constructed of non-conductive insulative material to segregate said stab connectors and prevent arcing, corona discharge or water born shorting.

9. The hermaphroditic electrical coupling assembly in accordance with claim 6 wherein said first end of said stab connectors extend beyond said coupling end of said body member facilitating positive conductive contact with an opposing stab connector situated in said opposing body member.

10. A method for connecting or coupling wire to wire fixtures or series harnesses by means of a hermaphroditic electrical coupling assembly defined by a pair of coupling members, said method comprising:

a. forming a body member defined by a coupling end and an opposing electrical wire receiving end defined by a plurality of apertures for passage there through of conductive electrical wire for fixedly securing their end to said body member, said body member comprising a top wall, bottom wall, and opposing side walls, there being disposed between said top wall and said bottom wall a plurality of rib members, said rib members defining channels, said top wall of said body member having an extending locking finger and said bottom wall of said body member having a receiving slot;

b. forming a plurality of stab connectors fabricated of conductive material and defined by a central web portion having a first end and a second end bent to the same side of said web, said first end bent at an acute angle with said web portion, said second end bent perpendicularly to said web portion and then bent angularly downwardly terminating distal proximate said web portion thereby defining a retentive gap between said web and said second end, said vertical bent portion of said second end of said stab connector having an aperture there through alignable with said aperture in said cable receiving end of said body member;

c. positioning said stab connectors in said channels of said body member juxtaposing said second bent end of said stab connector with said electrical receiving end of said body member, aligning said aperture in said perpendicular member of said stab connector with said aperture in said electrical wire receiving end of said body member;

d. inserting said electrical wire connectors through said apertures in said electrical wire receiving end of said body member and said apertures in said second perpendicular end of said stab connectors and directing said electrical wire connectors through said retentive gap and retentively engaging said electrical wire connectors by spring tension of said second end bent distal proximate said web in said retentive gap; and e. inverting one said body member; and f. snap locking said body member with said inverted body member by snap fitting said extended locking finger of said body member with said receiving slot of said inverted body member and said extended locking finger of said inverted body member with said receiving slot of said body member thereby securing said body members to form said hermaphroditic electrical coupling assembly.

* * * * *